US008815976B2

(12) United States Patent
Thiel

(10) Patent No.: US 8,815,976 B2
(45) Date of Patent: Aug. 26, 2014

(54) HUMIC SUBSTANCES-BASED POLYMER SYSTEM

(75) Inventor: Gerard R. Thiel, Dysart, IA (US)

(73) Assignee: University of Northern Iowa Research Foundation, Cedar Rapids, IA (US)

( * ) Notice: Subject to any disclaimer, the term of this patent is extended or adjusted under 35 U.S.C. 154(b) by 85 days.

(21) Appl. No.: 12/742,560

(22) PCT Filed: Nov. 14, 2008

(86) PCT No.: PCT/US2008/083603

§ 371 (c)(1),
(2), (4) Date: Aug. 6, 2010

(87) PCT Pub. No.: WO2009/065018

PCT Pub. Date: May 22, 2009

(65) Prior Publication Data

US 2011/0190444 A1 Aug. 4, 2011

Related U.S. Application Data

(60) Provisional application No. 60/987,953, filed on Nov. 14, 2007.

(51) Int. Cl.
*B22C 1/00* (2006.01)
*B22C 9/00* (2006.01)

(52) U.S. Cl.
USPC ..... 523/139; 523/142; 521/101

(58) Field of Classification Search
USPC ..... 523/139, 142; 521/101
See application file for complete search history.

(56) References Cited

U.S. PATENT DOCUMENTS

| | | | | |
|---|---|---|---|---|
| 3,409,579 | A | 11/1968 | Robins | |
| 3,429,848 | A | 2/1969 | Robins | |
| 3,432,457 | A | 3/1969 | Robins | |
| 3,645,942 | A | 2/1972 | Brown et al. | |
| 3,676,392 | A | 7/1972 | Robins | |
| 3,925,296 | A | 12/1975 | Stone | |
| 4,162,238 | A | 7/1979 | Bergna | |
| 4,179,427 | A * | 12/1979 | Gardikes | 523/143 |
| 4,851,457 | A | 7/1989 | Kurple | |
| 5,244,473 | A | 9/1993 | Sardessai | |
| 5,455,287 | A | 10/1995 | Carpenter et al. | |
| 5,698,613 | A * | 12/1997 | Jhaveri | 523/139 |
| 5,769,933 | A * | 6/1998 | Landis | 106/38.2 |
| 5,916,826 | A | 6/1999 | White | |
| 6,264,775 | B1 | 7/2001 | Holeschovsky et al. | |
| 6,291,550 | B1 * | 9/2001 | Chen et al. | 523/142 |
| 6,506,223 | B2 | 1/2003 | White | |
| 6,530,966 | B1 | 3/2003 | Kriech | |
| 6,559,203 | B2 | 5/2003 | Hutchings et al. | |
| 6,822,042 | B2 | 11/2004 | Capps | |
| 8,309,620 | B2 * | 11/2012 | Fuqua | 521/101 |
| 8,426,494 | B2 * | 4/2013 | Fuqua et al. | 523/142 |
| 8,436,073 | B2 * | 5/2013 | Di et al. | 523/139 |
| 8,623,959 | B2 * | 1/2014 | Fuqua et al. | 525/54.5 |
| 2005/0017394 | A1 | 1/2005 | Hochsmann | |
| 2008/0277351 | A1 | 11/2008 | Harman | |
| 2010/0319874 | A1 | 12/2010 | Thiel et al. | |
| 2011/0082233 | A1 * | 4/2011 | SenGupta et al. | 523/142 |
| 2013/0203887 | A1 * | 8/2013 | Fuqua et al. | 523/142 |
| 2013/0237635 | A1 * | 9/2013 | Di et al. | 523/142 |

FOREIGN PATENT DOCUMENTS

| | | | |
|---|---|---|---|
| CA | 843443 | A | 6/1970 |
| EP | 361447 | B1 | 2/1994 |
| EP | 769338 | A1 | 4/1997 |
| EP | 813921 | A1 | 12/1997 |
| EP | 746432 | B1 | 12/2001 |
| WO | 8000135 | A1 | 2/1980 |
| WO | 0228937 | A1 | 4/2002 |
| WO | 2009004086 | A1 | 1/2009 |
| WO | 2009065015 | A1 | 5/2009 |
| WO | 2009065018 | A1 | 5/2009 |
| WO | 2011044003 | A1 | 4/2011 |
| WO | 2011044004 | A1 | 4/2011 |
| WO | 2011044005 | A1 | 4/2011 |

OTHER PUBLICATIONS

Drop on Water: Humic Substances, Nova Scotia Environment, http://www.gov.ns.ca/nse/water/docs/droponwaterFAQ_HumicSubstances.pdf.*

Communication with the Extended European Search Report for Application No. 088492582 / Publication No. 2222424 dated Jun. 10, 2011, 2 pages.

Communication with the Extended European Search Report for Application No. 088507868 / Publication No. 2234742 dated Aug. 19, 2011, 10 pages.

Notification Concerning Transmittal of International Preliminary Report on Patentability (Chapter I) for International Application No. PCT/US2008/083597 dated May 27, 2010, 6 pages.

Notification Concerning Transmittal of International Preliminary Report on Patentability (Chapter I) for International Application No. PCT/US2008/083603 dated May 27, 2010, 6 pages.

Notification of Transmittal of the International Search Report and the Written Opinion of the International Searching Authority, or Declaration for International Application No. PCT/US2008/083597 dated Jan. 21, 2009, 7 pages.

(Continued)

*Primary Examiner* — Mark Eashoo
*Assistant Examiner* — Chelsea M Lowe
(74) *Attorney, Agent, or Firm* — Fredrikson & Byron, P.A.

(57) ABSTRACT

A system for use in forming polymer compositions, including as a replacement for phenolic based resin systems, for instance, in preparing foundry molds. In a preferred embodiment, the system includes the use of a) a polyermizable hydroxyl-containing component comprising a humic substance (as can be provided by lignite), b) an isocyanate component, and c) a catalyst, and preferably amine catalyst, component adapted to catalyze the polymerization of a) and b). The system is optionally used as binder system in the presence of a filler, such as, in combination with a foundry aggregate such as sand. A polymer system of this invention can be substantially free of formaldehyde or phenol, and preferably contains little or no aromatic solvents.

13 Claims, 1 Drawing Sheet

(56) References Cited

OTHER PUBLICATIONS

Notification of Transmittal of the International Search Report and the Written Opinion of the International Searching Authority, or Declaration for International Application No. PCT/US2008/083603 dated Jan. 12, 2009, 7 pages.

The State Intellectual Property Office of the People's Republic of China, Office Action dated Feb. 23, 2012 for Application No. 200880116283.9, 5 pages.

The State Intellectual Property Office of the People's Republic of China, Office Action dated Jan. 29, 2012 for Application No. 200880116282.4, 19 pages with its English translation.

U.S. Patent and Trademark Office Communication (Restriction Requirement) for U.S. Appl. No. 12/742,551 dated Jan. 12, 2012, 8 pages.

Written Opinion of the International Searching Authority for International Application No. PCT/US2010/051251 dated Apr. 6, 2012, 4 pages.

Written Opinion of the International Searching Authority for International Application No. PCT/US2010/051253 dated Apr. 6, 2012, 5 pages.

Written Opinion of the International Searching Authority for International Application No. PCT/US2010/051254 dated Apr. 6, 2012, 6 pages.

* cited by examiner

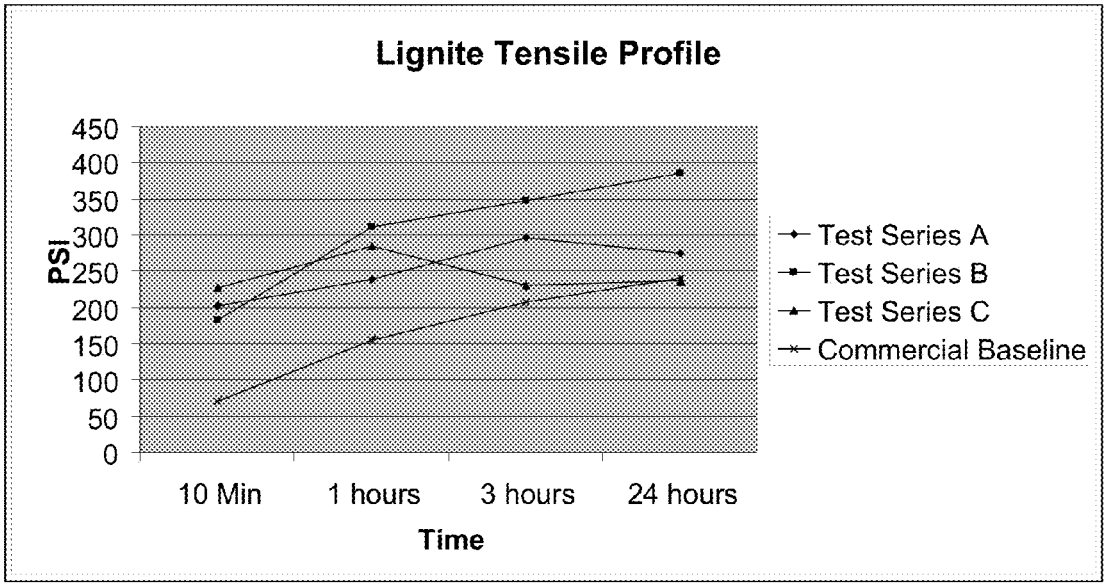
Lignite Tensile Profile
PSI
450
400
350
300
250
200
150
100
50
0
10 Min
1 hours
3 hours
24 hours
Time
Test Series A
Test Series B
Test Series C
Commercial Baseline

HUMIC SUBSTANCES-BASED POLYMER SYSTEM

CROSS-REFERENCE TO RELATED APPLICATIONS

The present application claims priority to International Application No. PCT/US2008/083603 filed 14 Nov. 2008, which in turn claims priority to U.S. Provisional Application No. 60/987,953 filed 14 Nov. 2007, the teachings of all of which are incorporated herein by reference.

TECHNICAL FIELD

This invention relates to urethane forming systems, including foundry binders, and mixes prepared with these systems and binders.

BACKGROUND OF THE INVENTION

Conventional foundry binders include both a phenol formaldehyde component and an organic polyisocyanate component. Foundry mixes are prepared by mixing the binder with a foundry aggregate. Foundry shapes (molds and cores) are typically prepared by shaping the mix and curing the foundry shape with a liquid or gaseous tertiary amine curing catalyst.

One of the major processes used in the foundry industry for making metal parts is sand casting. In sand casting, disposable foundry shapes (usually characterized as molds and cores) are made by shaping and curing a foundry mix which is a mixture of sand and an organic or inorganic binder. The binder is used to strengthen the molds and cores.

One of the processes used in sand casting for making molds and cores is the "cold-box" process. In this process a gaseous curing agent is passed through a compacted shaped mix to produce a cured mold and/or core. An alternative process is the "no bake" method, that involves the use of liquid catalysts such as tertiary liquid amines.

A phenolic-urethane binder system commonly used in the cold-box process is cured with a gaseous tertiary amine catalyst. See for example U.S. Pat. Nos. 3,409,579, 3,429,848, 3,432,457, and 3,676,392. The phenolic-urethane binder system usually consists of a phenolic resin component and polyisocyanate component which are mixed with sand prior to compacting and curing to form a foundry mix. Such phenolic-urethane binders used in the cold-box process, have proven satisfactory for casting such metals as iron or steel which are normally cast at temperatures exceeding about 1400 C. They are also useful in the casting of light-weight metals, such as aluminum, which have melting points of less than 800 C.

There are disadvantages to using phenolic resin systems, regardless of whether the system is filled (e.g., with aggregate) or unfilled, e.g., for use in other applications.

With regard to filled systems, there are disadvantages to using phenolic-urethane binders in the cold-box process. Both the phenolic resin component and polyisocyanate component generally contain a substantial amount of organic solvent which can be obnoxious to smell. Additionally, these binders contain small amounts of free (i.e., unreacted) formaldehyde and free (i.e., unreacted) phenol which may be undesirable. Because of this, there is an interest in developing polymer systems, including for use as binders, which do not use organic solvents and do not contain free formaldehyde or free phenol. Additionally, when the two components of the phenolic-urethane binder system are mixed with the sand to form a foundry mix, they may prematurely react prior to curing with the gaseous catalyst. If this reaction occurs, it will reduce the flowability of the foundry mix when it is used for making molds and cores, and the resulting molds and cores will have reduced strengths.

SUMMARY OF THE INVENTION

The present invention provides a novel system for use in forming polymer compositions in a variety of applications, including as a binder system for preparing foundry molds. In a preferred embodiment, the system includes the use of a) a polymerizable hydroxyl-containing component ("PHCC") comprising a humic substance, b) an isocyanate component, and c) a catalyst, and preferably amine catalyst, component adapted to catalyze the polymerization of a) and b), whereby a) and b), and c) as well, if included and used as a liquid, can be provided in a solvent based system (i.e., a system of this invention including solvent in a role such as diluent). In a particularly preferred embodiment, the humic substance itself can comprise humic acid and/or fulvic acid. The system can be used in its own right (e.g., to form a laminated layer, coating, or to form an article in its own right), or can be mixed with and cured in the presence of a filler material, including a foundry aggregate such as sand. The system of this invention can be used in any suitable manner with regard to foundry aggregates, including in either a cold box process or no bake process as described herein.

The polymer forming (e.g., binder) system of this invention can be used to replace, in whole or in part, conventional phenolic based polymeric systems, including in filled or unfilled systems. In turn, a preferred system of this invention is substantially free of formaldehyde or phenol, and preferably contains little or no aromatic solvents. When reactive solvents or no solvents are used, there are no volatile organic compounds (VOC's) present in the system. Thus, the compositions of this invention are environmentally attractive.

In another aspect, the invention provides humic substance (e.g., lignite)-containing PHCC compositions that are adapted (e.g., in either chemical and/or physical ways) for use in preparing a polymeric (e.g., binder) system of this invention, as well as kits and combinations that include two or more of components a), b) and/or c), and that are selected and used for preparing a polymeric (e.g., binder) system of this invention. In turn, such a kit or combination preferably provides the components in actual and relative amounts and/or concentrations adapted for their use.

BRIEF DESCRIPTION OF THE DRAWINGS

FIG. 1 is a graph showing Lignite Tensile Profile.

DETAILED DESCRIPTION

In one embodiment, the system of this invention provides a binder system that comprises a polymerizable hydroxyl-containing component (PHCC) comprising a lignite composed primarily of humic acid.

In another embodiment, the PHCC comprises hydroxyl-containing humic substances from any source. Such humic substances can include both humic acids and fulvic acids, and can be derived from a variety of organic, mineraloid, and mineral sources. Suitable organic sources, for instance, include plant sources such as peat and compost. Suitable mineraloid or mineral sources, for instance, include lignites as described below.

Humic substances in soils and sediments can be divided into three main fractions: humic acids (HA or HAs), fulvic acids (FA or FAs) and humin. The HA and FA tend to have sufficient OH content for use in this invention, and can be extracted from soil and other solid phase sources using a strong base (NaOH or KOH). Humic acids are insoluble at low pH, and can be precipitated by adding strong acid (adjust to pH 1 with HCl). Humin cannot be extracted with either a strong base or a strong acid. See, generally, www.ihss.gatech.edu/.

A PHCC, as used in this invention, can include monofunctional alcohols and polyols. Monofunctional alcohols include, but are not limited to, aliphatic alcohols such as methanol and ethanol. Polyols can include, but are not limited to, materials that contain humic substances, such as lignites. The term "polyol" in the present invention is defined as a compound having at least two hydroxyl groups capable of reacting with an isocyanate. As exemplified below, one preferred non-humic substance (and non-lignite) polyol is ethylene glycol, a relatively simple molecule having two hydroxyl groups. Without limiting the scope of the invention, representative examples of other non-lignite polyols include 1,2-propylene glycol; 1,3-propylene glycol; hexane 1,6-diol; 2-methyl-1,3-propanediol; glycerol; mannitol; sorbitol; diethylene glycol; triethylene glycol; polyethylene glycols; polypropylene glycols; and butylene, dibutylene, and polybutylene glycols.

The non-humic substance PHCC's, if present, are preferably present in the binder system in an amount ranging from about 1 to about 60 weight percent of the system (i.e., combination of whatever PHCC, isocyanate, liquid catalyst and solvent(s) may be present), more preferably from about 10 to about 50 weight percent of the system, and most preferably from about 15 to about 25 weight percent of the system. When the amount of PHCC's provided by non-humic substances is above about 60 weight percent, the resulting composition or binder tends to lower the mechanical strength of the resulting polymer.

Preferred humic substances for use in the present invention can be provided by mineraloids, preferably lignite, and more preferably leonardite. Lignite is often referred to as brown coal and is the lowest rank of coal and used almost exclusively as fuel for steam-electric power generation. It is brownish-black and has a high inherent moisture content, sometimes as high as 66 percent, and very high ash content compared with bituminous coal. It is also a heterogeneous mixture of compounds for which no single structural formula will suffice. Lignite is a geological material not considered a true mineral, but rather a minerialoid derived from decaying wood under extreme pressure, and thus organic. In the preferred embodiment the lignite used is comprised of Leonardite and contains more than 60% of humic acid. Humates and humic acid derivatives are a diverse family of products, generally obtained (directly or indirectly) from various forms of oxidized coal.

Coal deposits are of three types. Anthracite coal is very dense and hard with quite low sulphur content. Bituminous coal is a softer coal, usually with rather high sulphur levels. Lignite coal is a very soft, coarse coal with highly variable sulphur content and often marginal fuel value. Softer coals, particularly lignite, are (as a result of their more open texture) subject to oxidation, especially if found in a near-surface deposit. While oxidation decreases the fuel value of lignite coals, it increases the percent of alkaline-extractable humic matter.

Oxidized-coal-derived (OCD) humus and humic substances are essentially the same as humus extracts from soil. In the case of lignite coal, the apparent end-product of natural oxidation is a soft, loose-textured, almost earthy OCD humus known as leonardite. Leonardite usually occurs at lignite outcrops, or at the top of very shallow beds of lignite, grading into the parent lignite seam. Leonardite is a low rank coal derived from prehistoric plant matter. It is found as outcropping of lignite deposits, usually very close to the surface. It differs from lignite by its high oxidation degree and the higher carboxy groups. Due to the large amount of living bacteria, leonardite was formed instead of coal in certain sedimentation layers. Being a highly decomposed compressed natural organic humus that has been further processed by microbial activity, leonardite has a high humic acid content which is one of the most bio-chemically active substances.

Partially-oxidized lignite is called slack lignite and contains far less OCD humus than leonardite, but nevertheless more than lignite. The following table summarizes approximate chemical properties of potential sources of OCD humus:

| | Lignite | Slack lignite | Leonardite |
|---|---|---|---|
| Oxygen in source material | 20% | 25% | 30% |
| Extracted humic acids | 5% | 30% | 85% |
| Oxygen in humic acid extracts | 25% | 30% | 30% |

Consequently, one of ordinary skill in the art will understand that the present invention encompasses the use of humic substances derived from lignites (including slack lignite and Leonardite) as well as combinations and mixtures thereof, with high concentrations of humic acid, irrespective of source.

The one or more lignites are preferably present in the polymer (e.g., binder) system in an combined amount ranging from about 2, and more preferably from about 5, to about 65 weight percent of the binder, more preferably from about 10 to about 50 weight percent of the binder, and most preferably from about 15 to about 40 weight percent of the binder. Amounts of lignite higher than about 65 weight percent tend to consume too much isocyanate to be economically viable, while amounts lower than about 2 weight percent tend to not demonstrate appreciable improvement in mechanical performance as compared to a comparable composition lacking the lignite. In turn, when humic substances sources other than lignite are used, e.g., plant sources, those skilled in the art will be able to determine the optimal amount to be used (correlating at least in part to the inherent OH content of the source) in order to provide the desired levels of such properties as viscosity, miscibility, the rate and extent of polymerization, and so on, given the type, concentration, and manner in which other ingredients such as isocyanate, catalyst and other optional ingredients (e.g., solvents) are used.

The polymer (e.g., binder) system of this invention further comprises an isocyanate component. Isocyanates useful in the current invention include those that perform as suitable building blocks in polyurethane chemistry such as aromatic, aliphatic, or cycloaliphatic polyisocyanates having at least two active isocyanate groups per molecule. Preferred isocyanates include "Mondur 541", a commercially available diphenylmethane diisocyanate, a polyisocyanate, and Rubinate (1780), a water-compatible polyisocyanate based on diphenylmethane diisocyanate, commercially available from Huntsman-ICI.

Without limiting the scope of the invention, representative examples include 2,4- and 2,6-diisocyanatotoluene (TDI) and their derivatives; methylenediphenyl 4,4'-, 2,4- and 2,2'-diisocyanates (MDI) and their derivatives; industrial products which may additionally comprise products having more than one ring (polymeric MDI's or PMDI); 1,5-naphthalene diisocyanate (NDI); 4,4',4"-triisocyanatotriphenylmethane and bis(3,5-diisocyanato-2-methylphenyl)methane; 1,6-hexamethylene diisocyanate (HDI); and 3-isocyanatomethyl-3,5,5-trimethylcyclohexyl(isophorone) isocyanate (IPDI). Many such isocyanates are available commercially. Furthermore, basic polyisocyanates may also be modified by bi- or trimerization to produce carbodiimides, uretdiones, biurets, and allophanates.

The one or more isocyanates are preferably present in the polymer composition in an amount ranging from about 10 to about 80 weight percent of the overall composition, more preferably from about 20 to about 70 weight percent, and most preferably from about 30 to about 65 weight percent of the composition (e.g., resin).

The PHCC portion of the system may include solvents in addition to the lignite. These solvents may be reacting with the isocyanate component, such as alcohols and non-lignite polyols, or non-reactive with isocyanate, such as an alkylene carbonate, e.g., propylene carbonate, butylene carbonate, and the like. The solvent(s) can be used, at least in part, to adjust the viscosity of the system for its intended purpose, e.g., when used with an aggregate, to adjust the viscosity to between about 50 cps and about 400 cps, and more preferably between about 100 cps and about 300 cps.

Various types of filler materials can be used when the polymer system of this invention is used as a binder system to prepare a filled composition. Such fillers can have any suitable properties, e.g., in terms of size, shape, and chemical-physical properties. Examples of such fillers include, but are not limited to powder, granular, particulate, and fibrous materials, e.g., formed of organic (e.g., wood, cellulose) and/or inorganic materials (e.g., ceramic, silica, glass, mineral).

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used is known to those skilled in the art.

The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sand, and the like.

In ordinary sand type foundry applications, the amount of binder system (including any PHCC, isocyanate, and if present catalyst and solvent) is generally no greater than about 10% by weight and frequently within the range of about 0.2% to about 5% by weight based upon the weight of the aggregate. Most often, the binder content for ordinary sand foundry shapes ranges from about 0.5% to about 2% by weight based upon the weight of the aggregate in ordinary sand-type foundry shapes. The binder system of this invention is preferably made available as a three part system with the lignite component in one package, the organic polyisocyanate component in the second package, and the catalyst in the third package. When making foundry mixes, usually the binder components are combined and then mixed with sand or a similar aggregate to form the foundry mix or the mix can be formed by sequentially mixing the components with the aggregate. Preferably the lignite-containing PHCC and isocyanate are first mixed with the sand before adding the catalyst component. Methods of distributing the binder on the aggregate particles are well-known to those skilled in the art. The mix can, optionally, contain other ingredients such as iron oxide, ground flax fibers, wood cereals, pitch, refractory flours, and the like.

The catalyst component of this invention preferably comprises an amine catalyst, which can be provided in either liquid (e.g., as in a "no bake" process) or gaseous form (as in a cold box process), or both.

In a preferred embodiment, the process for preparing a foundry shape by the coldbox process comprises:

(1) providing the ingredients needed to form a binder system as described herein, (2) mixing the ingredients with a foundry aggregate under conditions suitable to then shape the foundry mix into a desired core and/or mold;

(3) contacting the shaped foundry mix with a catalyst (e.g., gaseous tertiary amine catalyst); and (4) removing the foundry shape of step (3) from the pattern.

In a preferred "cold box" embodiment of this invention the foundry mix (binder system and aggregate) can molded into the desired shape, whereupon it can be cured. Curing can be effected by passing a tertiary amine gas through the molded mix such as described in U.S. Pat. No. 3,409,579 which is hereby incorporated into this disclosure by reference. Gassing times are dependent on core weight and geometry and typically range from 0.5 to 30 seconds. Purge times are dependent on core weight and geometry and typically range from 1.0 to 60 seconds.

Metal castings are made by pouring molten metal into and around an assembly of molds and/or cores made with the subject binders and sand. In turn, using the cold box process, a preferred process of casting a metal comprises:

(1) preparing a foundry core and/or mold as described herein;

(2) providing and pouring metal while in the liquid state into and around said shape;

(3) allowing the metal to cool and solidify; and (4) then separating the molded article from the core or mold.

Given the present description, those skilled in the art will also appreciate the manner in which a binder system of this invention can also be used to form molds using a no bake process. In one such preferred embodiment, a binder system as described herein, including a liquid catalyst, is provided and used to contact a corresponding aggregate component to form a shaped core and/or mold. The catalyst can be included in any suitable manner and any suitable time, e.g., together with the PHCC component, at the time of mixing any of the components of the binder system together, or even after the combination of binder system with the aggregate.

In turn, a preferred no bake method using the system of the present invention can include:

(1) providing the ingredients needed to form a binder system as described herein, providing and mixing at least the PHCC, isocyanate and any solvents that may be used together in a composition, (2) including liquid catalyst in any suitable manner and time, e.g., within one or more of the individual ingredients, or adding it to the combination of ingredients prior to, during, and/or after contact with the foundry aggregate;

(3) mixing the ingredients with a foundry aggregate under conditions suitable to then shape and cure the foundry mix into a desired core and/or mold; (4) removing the foundry shape of step (3) from the pattern.

A suitable liquid amine catalyst for use in such a process is a base having a $pK_b$ value generally in the range of about 7 to about 11. The term "liquid amine" is meant to include amines which are liquid at ambient temperature or those in solid or gas form which are dissolved in appropriate solvents. The $pK_b$ value is the negative logarithm of the dissociation constant of the base and is a well-known measure of the basicity of a basic material. The higher this number is, the weaker the base. The bases falling within this range are generally organic compounds containing one or more nitrogen atoms. Specific examples of bases which have $pK_b$ values within the necessary range include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine. Preferably used as the liquid tertiary amine catalyst is an aliphatic tertiary amine, particularly [tris(3-dimethylamino) propylamine].

In view of the varying catalytic activity and varying catalytic effect desired, catalyst concentrations will vary widely. In general, the lower the $pK_b$ value is, the shorter will be the work time of the composition and the faster, more complete will be the cure. In general, catalyst concentrations will be a catalytically effective amount which generally will range from about 0.1% to about 90% by weight of the PHCC component, preferably 0.2% by weight to 80% by weight based upon the PHCC component. In a one embodiment of the invention, the liquid catalyst level is adjusted to provide a work time for the foundry mix of 1 minute to 30 minutes, preferably 4 minutes to about 10 minutes, and a strip time of about 1 minute to 30 minutes, preferably 5 minutes to about 12 minutes. Work time is defined as the interval of time between mixing the polyisocyanate, lignite, and catalyst and the time when the foundry shape reaches a level of 45 on the Green Hardness "B" Scale Gauge sold by Harry W. Dietert Co., Detroit, Mich. Strip time is the interval of time between mixing the polyisocyanate, polyol, and catalyst and the time when the foundry shape reaches a level of 90 on the Green Hardness "B" Scale Gauge. The aggregate employed with the catalyzed binder in producing the foundry mix should be sufficiently dry so that a handleable foundry shape results after a work time of 3 to 10 minutes and a strip time of 4 to 12 minutes. The bench life of the foundry mix is the time interval between forming the foundry mix and the time when the foundry mix is no longer useful for making acceptable molds and cores. A measure of the usefulness of the foundry mix and the acceptability of the molds and cores prepared with the foundry mix is the tensile strength of the molds and cores. If a foundry mix is used after the bench life has expired, the resulting molds and cores will have unacceptable tensile strengths. Because it is not always possible to use the foundry mix immediately after mixing, it is desirable to prepare foundry mixes with an extended bench life. Many patents have described compounds which improve the bench life of a phenolic-urethane foundry mix. Among the compounds useful to extend the bench life of the foundry mix are organic and/or inorganic phosphorus containing compounds.

Foundry shapes, including both foundry cores and molds, are made by mixing the binder compositions of the present invention with aggregates using mixing methods well known in the art. One common method is to meter the PHCC component, isocyanate component, and any catalyst into a foundry aggregate such as silica sand as it goes through a high speed continuous mixer to form a foundry mix. The foundry mix, i.e., the intimately mixed sand binder composition, is placed in a pattern and allowed to cure at ambient temperature. After curing, the self-supporting foundry shape can be removed from the pattern. The foundry shapes, typically including mold halves and any needed cores, are assembled to give a complete mold into which molten metal can be poured. On cooling, a metal casting having the shape of the sand mold is produced. Suitable aggregate materials for foundry shapes include silica sand, lake sand, zircon, olivine, chromite, mullite and the like.

Additives commonly used in the foundry art to improve casting quality such as black iron oxide, red iron oxide, clay, wood flour and the like may be incorporated into the foundry mix compositions. Other optional ingredients that may be added to the polyol component are adhesion promoters and release agents. Silane coupling agents such as gamma-ureidopropyltriethoxysilane, and gamma-aminopropyltrimethoxysilane may be added to increase tensile strengths and improve humidity resistance. Release agents such as glycerol trioleate and oleic acid may be added in small amounts to improve release from mold patterns. Although not preferred, core and mold coatings may be applied to the bonded sand cores and molds of this invention to reduce erosion and improve casting finish in difficult casting applications.

Unfilled systems of this invention can be used in a variety of ways, and to achieve a variety of purposes, as replacements for phenolic based resin (e.g., urethane) systems currently known. For instance, a system of the present invention can be used as a molding compound, as a protective coating, or as bonding or adhesive resin, for instance for use in laminating, coated or bonded abrasives, friction materials, insulation materials, plywood manufacture, and fibrous or granulated wood.

EXAMPLES

The following examples will serve to illustrate the preparation of several foundry binder compositions within the scope of the present invention. It is understood that these examples are set forth for illustrative purposes and that many other compositions are within the scope of the present invention. Those skilled in the art will recognize that similar foundry binder compositions may be prepared containing different quantities of materials and equivalent species of materials than those illustrated below. All parts are by weight unless otherwise specified.

In the following data, lignite is tested with different concentrations of isocyanate resins and additives. Although the data are not exhaustive, they will illustrate to one skilled in the art that lignite based formulations consistently provided highly practicable work/strip times. It is known to those experienced in the art, such times and tensile strengths may be suitable for a significant range of applications without substantial modification.

A mixture referred to as LH12 comprising of 20% lignite, 20% water, 20% propylene carbonate, and 40% ethylene glycol was produced. This mixture was used to replace the phenol formaldehyde component in a foundry binder system. A mixture referred to as LH13 was comprised of 19.9% lignite, 19.9% water, 19.9% propylene carbonate, 39.8% ethylene glycol, and 0.4% sodium hydroxide. Another mixture referred to as LH14 was comprised of 19.8% lignite, 19.8% water, 19.8% propylene carbonate, 39.7% ethylene glycol, and 0.8% sodium hydroxide. Both LH13 and LH14 were evaluated in the same means as LH12. The lignite concentration of LH14 can be calculated to be 3.4% by weight of the combination of ingredients making up the composition.

Sand was evenly coated with the LH12 component and then combined with a commercially available isocyanate and solvent mixture with an amine catalyst to form a phenolic urethane polymer adhesive that acted as a foundry sand binder. Coating of the sand consisted of mixing 3 kilograms of a 55 grain fineness number silica sand as defined by American Foundry Society, (AFS) standard procedure, AFS 1106-

00-s with 0.3% of the LH12 component, 1.2% of commercially available isocyanate and solvent mixture and 0.225% of a commercially available tertiary amine catalyst in paddle type mixer. After the sand was coated sufficiently the mixture was packed into the test coupon mold as per AFS 3342-00-S. Tensile strength of the bonded test coupons was measured according to AFS 3301-00-S at 10 minutes, 1 hour, 3 hours, and 24 hours after the sand had cured. Standard permeability and scratch hardness tests were also conducted using AFS 5223-00-S and AFS 3318-00-S. The testing procedure was repeated with the LH13 and LH14 mixtures. Results were compared to a commercially available phenolic urethane foundry binder comprised of Ashland Chemical PepSet X1000, PepSet X2000, and PepSet 3500. Proportions of the materials used were 55% Pep Set 1000, 45% Pep Set 2000, and 8% (binder weight) Pep Set 3500.

Test Series A was comprised of 20% LH12 and 80% commercially available MDI based isocyanate. The work time was 2.5 minutes and the strip time was 3.5 minutes as defined by AFS standard AFS 3180-00-S. Test Series B was comprised of 20% LH13 and 80% commercially available MDI based isocyanate. The work time was 2.5 minutes and the strip time was 3.5 minutes. Test Series C was comprised of 20% LH14 and 80% commercially available MDI based isocyanate. The work time was 2.5 minutes and the strip time was 3.5 minutes. Results of the commercial baseline were a work time of 3.5 minutes and strip time of 4.25 minutes.

When combined with commercially available MDI mixtures, the LH12-14 mixtures yielded tensile strengths equal to or higher than a commercially available phenol formaldehyde binder system at comparable or reduced cure rates.

What is claimed is:

1. A system for use in preparing a foundry mold, the system comprising:

a) a polymerizable hydroxyl-containing component comprising lignite at a concentration of between about 5 and about 65% by weight of the system, and one or more polyols present in an amount between about 1 and about 60% by weight of the system;

b) an isocyanate component comprising between about 10 and about 80% isocyanate, based on the weight of the system, and selected from the group consisting of consisting of 2,4- and 2,6-diisocyanatotoluene (TDI) and their derivatives, methylenediphenyl 4,4'-, 2,4- and 2,2'-diisocyanates (MDI) and their derivatives, polymeric MDI's (PMDI), 1,5-naphthalene diisocyanate (NDI), 4,4',4"-triisocyanatotriphenylmethane and bis(3,5-diisocyanato-2-methylphenyl)methane, 1,6-hexamethylene diisocyanate (HDI), and 3-isocyanatomethyl-3,5,5-trimethylcyclohexyl(isophorone) isocyanate (IPDI); and c) a catalyst component comprising a tertiary amine catalyst, the components adapted to be combined in order to form the polymer composition, wherein the hydroxyl groups that react in the polymerization of a) and b) consist of those provided by the component of a), the system excluding the presence of aggregate.

2. A system according to claim 1, wherein the polymer composition consists essentially of lignite and polyol as the polymerizable component.

3. A system according to claim 1, wherein the lignite is present at a greater concentration than polyol.

4. A system according to claim 1, wherein the catalyst component is present in an amount sufficient to provide a foundry work time of between about 1 and about 30 minutes or a foundry strip time of between about 1 and about 30 minutes.

5. A system according to claim 4, wherein the system is substantially free of phenol or formaldehyde and the system serves as a phenolic replacement in a conventional phenolic urethane no bake process.

6. A system for use in preparing a foundry mold, the system comprising:

a) a lignite present at a concentration of between about 5 and about 65% by weight of the system, the lignite comprising leonardite, and one or more polyols present in an amount between about 10 and about 50% by weight of the system;

b) an isocyanate component comprising between about 20 and about 70% isocyanate, based on the weight of the system, and selected from the group consisting of 2,4- and 2,6-diisocyanatotoluene (TDI) and their derivatives, methylenediphenyl 4,4'-, 2,4- and 2,2'-diisocyanates (MDI) and their derivatives, polymeric MDI's (PMDI), 1,5-naphthalene diisocyanate (NDI), 4,4',4"-triisocyanatotriphenylmethane and bis(3,5-diisocyanato-2-methylphenyl)methane, 1,6-hexamethylene diisocyanate (HDI), and 3-isocyanatomethyl-3,5,5-trimethylcyclohexyl(isophorone) isocyanate (IPDI); and c) a catalyst component comprising a catalyst selected from the group consisting of phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine, wherein the catalyst component is present in an amount sufficient to provide a foundry work time of between about 1 and about 30 minutes or a foundry strip time of between about 1 and about 30 minutes, and wherein the system is substantially free of phenol or formaldehyde and the system serves as a phenolic replacement in a conventional phenolic urethane no bake process, wherein the hydroxyl groups that react in the polymerization of a) and b) consist of those provided by the component of a), the system excluding the presence of aggregate.

7. A system according to claim 6 wherein the one or more polyols are selected from the group consisting of ethylene glycol, 1,2-propylene glycol, 1,3-propylene glycol, hexane 1,6-diol, 2 methyl-1,3-propanediol, glycerol, mannitol, sorbitol, diethylene glycol, triethylene glycol, polyethylene glycols, polypropylene glycols, butylene, dibutylene, and polybutylene glycols.

8. A system for use in preparing a foundry mold, the system comprising:

a) a lignite present at a concentration of between about 5 and about 65% by weight of the system, lignite comprising leonardite, and between about 10 and about 50% by weight of one or more polyols comprising triethylene glycol;

b) an isocyanate component comprising between about 20 and about 70% isocyanate, based on the weight of the system, and selected from the group consisting of 2,4- and 2,6-diisocyanatotoluene (TDI) and their derivatives, methylenediphenyl 4,4'-, 2,4- and 2,2'-diisocyanates (MDI) and their derivatives, polymeric MDI's (PMDI), 1,5-naphthalene diisocyanate (NDI), 4,4',4"-triisocyanatotriphenylmethane and bis(3,5-diisocyanato-2-methylphenyl)methane, 1,6-hexamethylene diisocyanate (HDI), and 3-isocyanatomethyl-3,5,5-trimethylcyclohexyl(isophorone) isocyanate (IPDI); and c) a catalyst component comprising a catalyst comprising N-methyl imidazole and 4-phenylpropylpyridine, wherein the catalyst component is present in an amount sufficient to provide a foundry work time of between about 4 and about 10 minutes and a foundry strip time of between about 5 and about 12 minutes, and wherein the system is substantially free of phenol or formaldehyde and the system serves as a phenolic replacement in a conventional phenolic urethane no bake process, and wherein the hydroxyl groups that react in the polymerization of a) and b) consist of those provided by the component of a), the system excluding the presence of aggregate.

9. A system for use in preparing a foundry mold, the system comprising:

a) a polymerizable hydroxyl-containing component comprising a humic substance consisting essentially of lignite at a concentration of between about 5 and about 65% by weight of the system, and one or more polyols present in an amount between about 1 and about 60% by weight of the system;

b) an isocyanate component comprising between about 10 and about 80% isocyanate, based on the weight of the system, and selected from the group consisting of consisting of 2,4- and 2,6-diisocyanatotoluene (TDI) and their derivatives, methylenediphenyl 4,4'-, 2,4- and 2,2'-diisocyanates (MDI) and their derivatives, polymeric MDI's (PMDI), 1,5-naphthalene diisocyanate (NDI), 4,4',4"-triisocyanatotriphenylmethane and bis(3,5-diisocyanato-2-methylphenyl)methane, 1,6-hexamethylene diisocyanate (HDI), and 3-isocyanatomethyl-3,5,5-trimethylcyclohexyl(isophorone) isocyanate (IPDI); and c) a catalyst component comprising a tertiary amine catalyst, the components adapted to be combined in order to form the polymer composition, wherein the hydroxyl groups that react in the polymerization of a) and b) consist of those provided by the component of a), the system excluding the presence of aggregate.

10. A system according to claim 9, wherein the polymer composition consists essentially of lignite and polyol as the polymerizable component.

11. A system according to claim 9, wherein the lignite is present at a greater concentration than polyol.

12. A system according to claim 9, wherein the catalyst component is present in an amount sufficient to provide a foundry work time of between about 1 and about 30 minutes or a foundry strip time of between about 1 and about 30 minutes.

13. A system according to claim 9, wherein the system is substantially free of phenol or formaldehyde and the system serves as a phenolic replacement in a conventional phenolic urethane no bake process.

* * * * *